US005230493A

United States Patent [19]

Luoto

[11] Patent Number: 5,230,493

[45] Date of Patent: Jul. 27, 1993

[54] HIDDEN MOUNTING BRACKET FOR A VENETIAN BLIND OR WINDOW COVERING HEADRAIL

[76] Inventor: Donald W. Luoto, 16642 Island Circle #3, Huntington Beach, Calif. 92649

[21] Appl. No.: 822,720

[22] Filed: Jan. 21, 1992

[51] Int. Cl.[5] ..... E06B 9/00; A47H 7/00

[52] U.S. Cl. ..... 248/251; 248/254; 248/262

[58] Field of Search ..... 248/251, 301, 254, 48.1, 248/48.2, 262, 316.8, 264; 160/902, 178.1, 38, 39, 19

[56] References Cited

U.S. PATENT DOCUMENTS

| | | | |
|---|---|---|---|
| 2,698,727 | 1/1955 | Rutledge | 160/902 X |
| 4,235,406 | 11/1980 | Vecchiarelli | 160/902 X |
| 4,254,814 | 3/1981 | Vecchiarelli | 160/38 X |
| 4,411,401 | 10/1983 | Anderson | 248/254 X |
| 4,607,818 | 8/1986 | Georgopoulas | 248/251 X |
| 4,802,644 | 2/1989 | Oskam | 248/254 X |
| 4,938,443 | 7/1990 | Rowe | 248/251 |
| 4,949,926 | 8/1991 | Liu | 160/178.1 X |
| 5,074,350 | 12/1991 | Carter | 248/262 X |

*Primary Examiner*—Karen J. Chotkowski
*Attorney, Agent, or Firm*—George J. Netter

[57] ABSTRACT

A mounting bracket (16) for a window covering (10) headrail (12), the latter having an open top defined by flanged edges with recesses (24, 26). The bracket (16) has a back plate (28), top plate (30), and forwardly/-downwardly extending spring arm plates (46,48) joined by a cross bar (50). In assembly, the bracket is mounted to a wall surface and the headrail (12) is locked onto the bracket by interaction of the spring arm plates, the greater part of the bracket being hidden within the headrail.

6 Claims, 2 Drawing Sheets

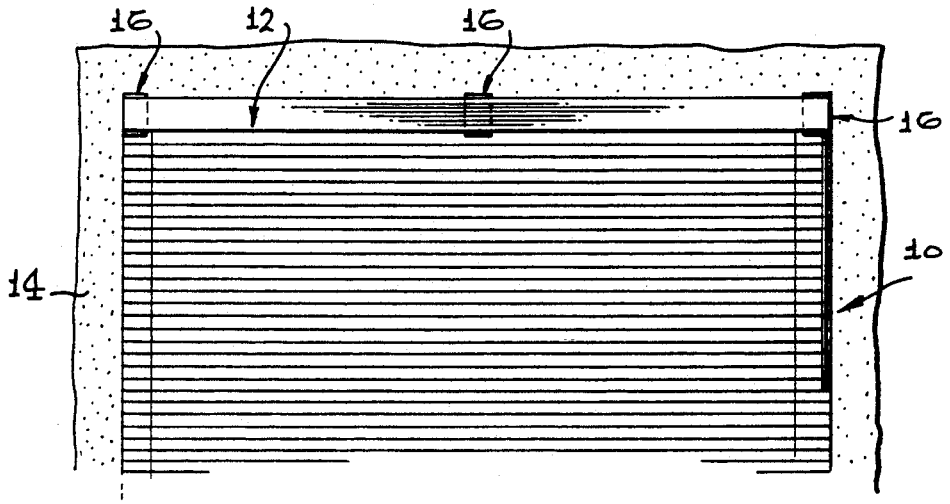
FIG. 1
FIG. 2
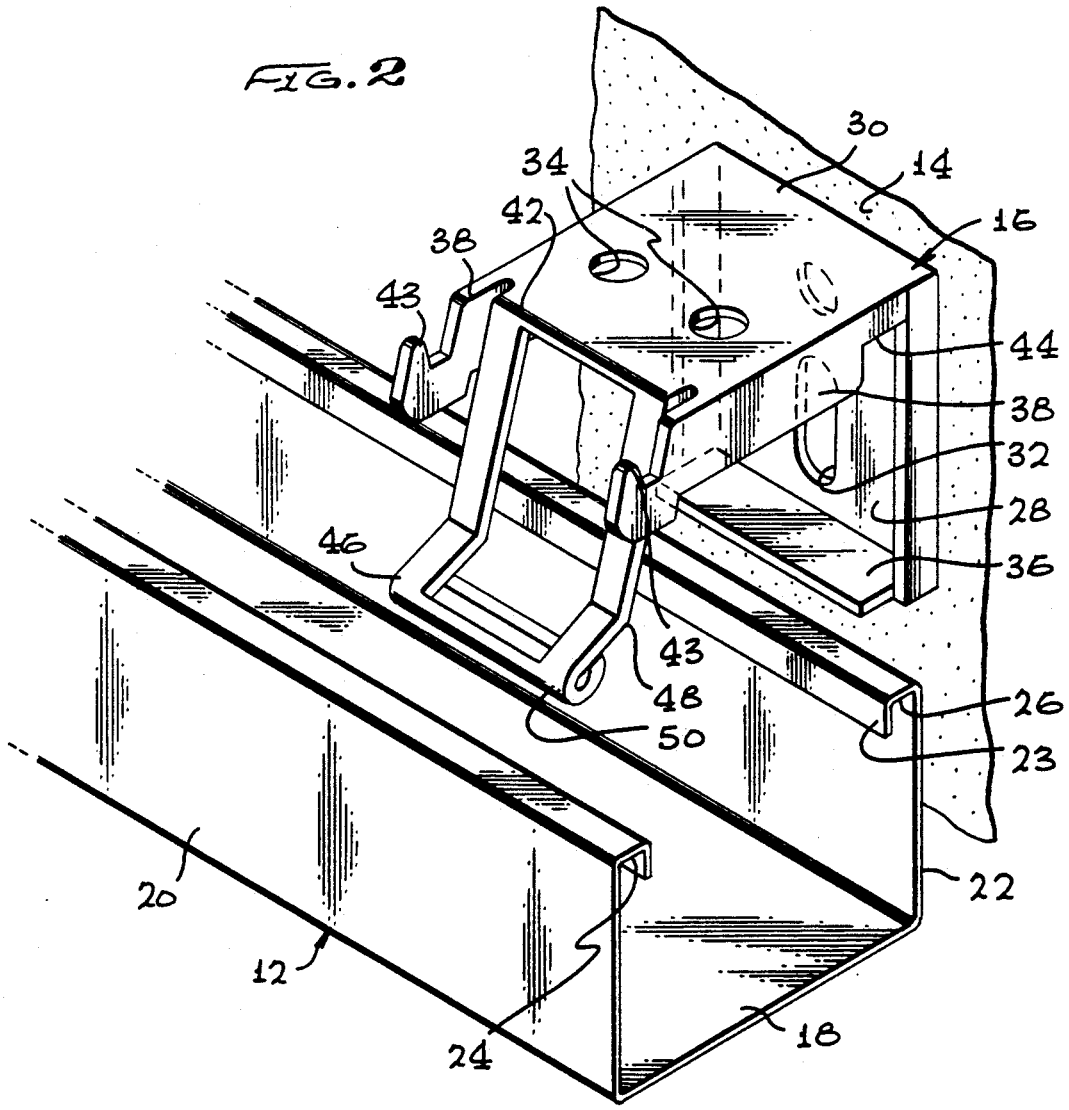

HIDDEN MOUNTING BRACKET FOR A VENETIAN BLIND OR WINDOW COVERING HEADRAIL

BACKGROUND OF THE INVENTION

1. Field of the Invention

The present invention relates generally to a bracket for mounting a headrail of a venetian blind or other window covering, and, more particularly, to such a bracket which is hidden from view when in use.

2. Description of the Related Art

A so called venetian blind consists of a plurality of slats which are arranged in overlapping relation to one another and hung as a unit from a headrail mounted either to a ceiling or a sidewall. A cord or a wand is provided for adjusting the spatial relationship of the slats to one another so as to provide a corresponding variation in the amount of light and viewing ability through the blind. There are also vertical wall coverings which include a length of pleated material that hang from a similarly mounted headrail. For either a venetian blind or a vertical wall covering it has been typical in the past to provide two or more brackets for affixing the headrail to the wall surface.

A standard venetian blind mounting used at the present time has a "box with door" design where the headrail has its ends inserted into a boxlike affair and a door is closed to secure them together. This type of construction requires a left and right unit which must be available in sufficient colors to match those in which the blind is available. It is clearly undesirable for the blind fabricator to have to inventory two separate items in many different colors if the function can be accomplished by a single item.

SUMMARY OF THE INVENTION

A headrail that is typical at the present time is generally parallelepiped in construction with unitary front, back and bottom panels, and having an open top. In addition the top edges of the front and back panels are deformed downwardly into the internal space of the headrail forming a downwardly facing recess along each of the two upper panel edges.

The bracket of the present invention for mounting the headrail to a wall as seen from a headrail end is generally L-shaped having one arm of a length substantially equal to the spacing between the front and the rear headrail panels and a second arm of a length substantially equal to the headrail rear wall height. The first arm has on an outer end a hook-like means for being received within one recess of the overturned edge of the headrail front panel. The inner surface of the first arm adjacent the second arm has material removed in order to provide a slot that fits over the rear wall upper edge when assembled to the headrail. The outer end of the second arm includes a tab that extends parallel to the first arm a limited extent for fitting receipt under the headrail bottom panel and rear corner in assembly. A pair of elongated spring members extend away from the first arm for contacting the inner-surface of the headrail bottom and front panels when the bracket is mounted thereon.

In use, at least two or sometimes more brackets, are mounted to the ceiling or room side wall surface at an appropriately desired location. Next, the headrail is angularly held with respect to the brackets so that the front panel can be placed over the bracket hooked end and the front panel recess can be received over the hooked end portion at the same time. The headrail is now rotated toward the second arm of the bracket in order to be locked in place with the spring members providing the retention force.

BRIEF DESCRIPTION OF THE DRAWING

In the accompanying drawing:

FIG. 1 is a front elevational view of a wall covering unit shown mounted to a wall by use of brackets of the present invention;

FIG. 2 a perspective view of the bracket of this invention as shown closely adjacent a headrail prior to assembly therewith;

DESCRIPTION OF A PREFERRED EMBODIMENT

Figure 3:
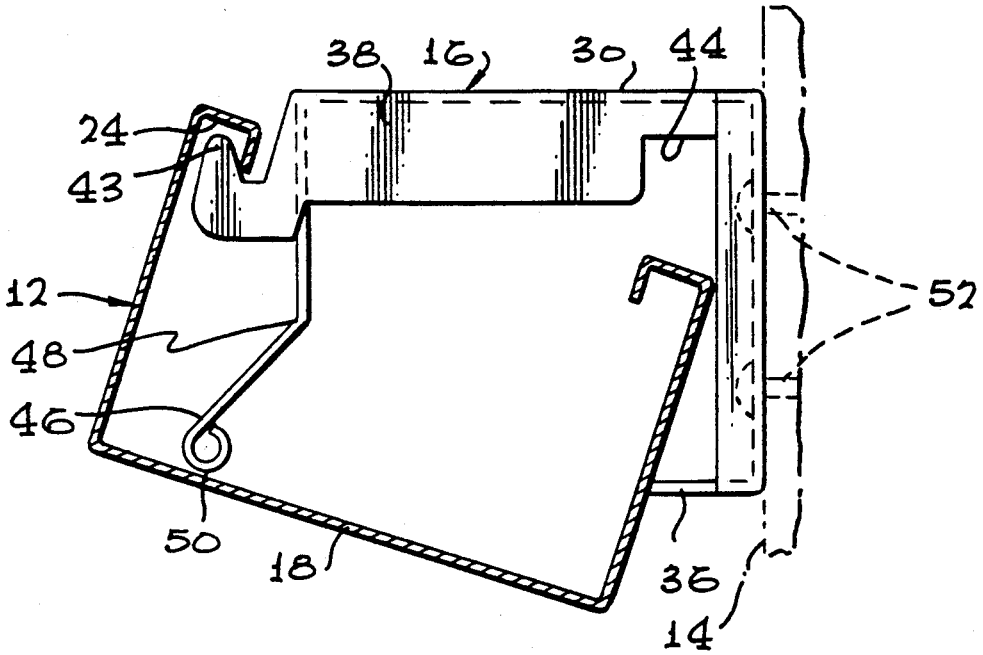
FIG. 3 shows a headrail being partially assembled to a bracket of this invention.
Figure 4:
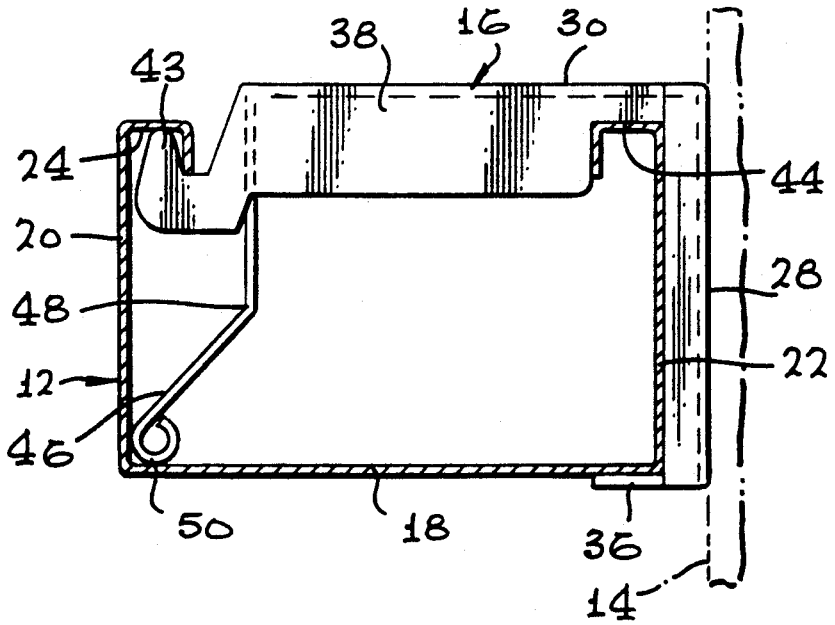
FIG. 4 shows a side elevational sectional view of a headrail fully mounted on the bracket.

Turning now to the drawing and particularly FIG. 1, there is shown a wall covering unit 10 in hanging assembly from a headrail 12, the latter being secured to a wall 14, such as a vertical wall in a house, for example. The headrail is down mounted, in a way to be more particularly described, by three brackets 16 of the present invention. However, depending upon length and weight of the headrail and window covering, the number of brackets may be as few a two or more than three. The brackets, as will be made clear, are essentially invisible to anyone standing at the front or side of the wall covering unit making the entire assembly more aesthetically pleasing.

The headrail 12 is of conventional construction consisting of either formed metal or molded plastic with a bottom panel 18, front and rear panels 20 and 22, and an open top 23. When in use, the headrail includes various apparatus for raising and lowering the venetian blind or wall covering and is mounted to a wall surface such as the wall 14 at a convenient desired location. The upper edges of the front and rear panels 20 and 22 are formed over into the containing space of the headrail providing respective flanges with downwardly facing recesses 24 and 26.

The mounting bracket of this invention 16 can be seen best in FIG. 2 and is preferably stamped from a sheet of metal with the various parts formed together into a single unitary bracket. Alternatively, the bracket may be constructed of molded plastic or, alternatively, die cast.

With respect to the ensuing detailed construction of the bracket 16, reference is made particularly to FIG. 2. The bracket includes a back plate 28 and a top plate 30 formed at substantially ninety degrees to one another, each having one or more mounting openings 32 and 34 via which screws or the like (not shown) are used to mount the bracket, and thus the headrail, to a vertical wall surface or a ceiling, as desired. The lower edge portion 36 of the back plate 28 is formed at ninety degrees to the back plate and in the same direction as the top plate extends to act as a mounting tab.

A pair of identically shaped and dimensioned arms 38 are provided along each side of the top plate and extending forwardly of the back plate edge portion 42 and each arm has an outer end portion formed into a hook-like member 43. At the opposite end of each of the arms 38 immediately adjacent the back plate 28 there is provided a recess 44 of sufficient dimensions permitting receipt over a folded rear panel top edge.

Extending from the forward edge 42 of the top plate 30 and located between the side arms 38 are a pair of spaced apart spring arm plates 46 and 48 joined together by a cross bar 50 at their outer ends. As seen from the side elevational view in FIG. 3 for example, the spring arms first extend at 90 degrees downwardly away from the top plate 30 and then angularly forward. The cross bar 50 is formed into generally cylindrical shape with only rounded portions facing downwardly and forwardly with no sharp edges or corners which can mar the headrail inner wall surface or remove paint therefrom during use.

To illustrate use of the present invention, reference is now made to FIG. 3. As a first step, at least two brackets 16 are mounted at a desired location on, say, a vertical wall 14 by use of screws 52 or other such means. Next, the headrail is placed on the bracket from below so that the bracket hooks 43 are positioned within the front panel recess 24. Then, the headrail is pivoted upwardly about the hooklike members until the headrail rear panel top edge is located within recess 44 at which time the lower edge portion or tab 36 is simultaneously locked under the headrail. The headrail is now firmly mounted and substantially completely invisible from the outside. The spring arms 46 serve to hold the headrail and bracket tightly together.

If mounting is to be made to a ceiling, it is to be noted that the upper surface of the hooklike members 43 is spaced downwardly from the general plane of the top plate to permit access of the headrail front panel top edge between the ceiling and hooklike members as is necessary during the initial part of locking engagement.

Although the invention has been described in connection with a preferred embodiment, it is to be understood that those skilled in the appertaining art may make modifications which come within the spirit of the invention and the ambit of the appended claims.

What is claimed is:

1. A wall mounted bracket for releasable securement to a headrail having an open surface defined by a pair of spaced apart edges formed into flanges each having a recess, comprising:

a generally L-shaped body having unitary back and top plates, a lower edge portion being formed to extend in the same direction as the back plate;

first and second arms integral with the top plate extending along opposite sides of said plate and each having an internal recess adjacent the backplate and hooklike means adjacent an outer end; and elongated spring means having an end secured to the top plate edge opposite the back plate extending downwardly and forwardly away from the back plate, a said spring means include first and second spared apart arms extending away from the top plate and a cross bar interconnecting the outer ends of the said arms;

said bracket on assembly receiving one headrail edge flange within the internal recesses, the other headrail edge flange lockingly engaged with the hooklike means, and the outer end portions of the spring means being anchored within the headrail.

2. A wall mounted bracket as in claim 1, in which the first and second arms extend downwardly from the top plate at substantially 90 degrees for a prescribed distance and then extend angularly forwardly away from the back plate.

3. A wall mounted bracket as in claim 1, in which the cross bar is in cylindrical form with a peripheral surface free from sharp portions.

4. A wall mounted bracket as in claim 1, in which the bracket is constructed from a single piece of flat metal.

5. A wall mounted bracket as in claim 1, in which the top and back plates each include at least one opening for use in wall mounting.

6. A wall mounted bracket as in claim 1, in which the bracket is constructed of molded plastic.

* * * * *